United States Patent [19]

Bucher

[11] 4,041,987

[45] Aug. 16, 1977

[54] JACQUARD MACHINE EQUIPPED WITH LIFTING WIRES AND STATIONARY ARRESTING BLADES

[75] Inventor: Robert Bucher, Frick, Switzerland

[73] Assignee: Sulzer Brothers Limited, Winterthur, Switzerland

[21] Appl. No.: 716,785

[22] Filed: Aug. 23, 1976

[51] Int. Cl.[2] ..... D03C 3/00; D03C 3/08

[52] U.S. Cl. ..... 139/59; 139/65

[58] Field of Search ..... 139/59–65

[56] References Cited

U.S. PATENT DOCUMENTS

| | | | |
|---|---|---|---|
| 3,289,707 | 12/1966 | Wittendal | 139/63 |
| 3,455,339 | 7/1969 | Seiler | 139/65 X |
| 3,835,895 | 9/1974 | Bassi | 139/65 |
| 3,865,148 | 2/1975 | Wolfgang et al. | 139/59 |

FOREIGN PATENT DOCUMENTS

| | | | |
|---|---|---|---|
| 2,032,182 | 11/1970 | France | 139/65 |
| 2,455,035 | 5/1975 | Germany | 139/65 |

*Primary Examiner*—James Kee Chi

*Attorney, Agent, or Firm*—Werner W. Kleeman

[57] ABSTRACT

A Jacquard machine of the type possessing to-and-fro moving lifting wires having arresting hooks for coupling with stationary arresting blades. At least one stationary guide edge is provided at the region of a stationary arresting blade fixing the lower shed position. This guide edge cooperates with a projection located at the neighboring lifting wire moving into the lower shed position, so that the lifting wire is deflected and in the lower shed position is coupled with the associated stationary arresting blade.

3 Claims, 5 Drawing Figures

4
31
1
32
14
15
6
7
2
10
12
9
13
8
16
21
17
16a
21a
22
18
18a
19
22a
16b
21b
30
21c
16c

JACQUARD MACHINE EQUIPPED WITH LIFTING WIRES AND STATIONARY ARRESTING BLADES

BACKGROUND OF THE INVENTION

The present invention relates to a new and improved construction of a Jacquard machine equipped with to-and-fro moving lifting wires equipped with arresting hooks for coupling the lifting wires with stationary arresting blades. The invention of the present disclosure has particular applicability with double lift-open shed-Jacquard machines using single lifting wires (single-leg lifting wires).

According to a prior art loom of this general type, as disclosed in Swiss Pat. No. 552,691, corresponding to U.S. Pat. No. 3,871,415 the lifting wires are guided at their lower region through a stationary lifting wire board or floor portion. In the event that the coupling action between the lifting wires and the lifting blades does not proceed according to the programme contemplated, for some reason or other, for instance due to oscillations or deformation of the lifting wires, then, the lifting wires undesirably can drop until reaching the lifting wire board, under the action of a spring which pulls such lifting wires downwards. The lifting wire-entrainment hooks coacting with the lifting blades can be guided out of the region where they can be coupled with the lifting blade-entrainment hooks, so that the lifting wires no longer can be entrained by the lifting blades. When this happens there is required relatively complicated repair work.

SUMMARY OF THE INVENTION

Hence, it is a primary object of the present invention to provide a Jacquard machine which is specifically improved in this regard.

Another and more specific object of the present invention aims at the provision of a new and improved construction of a Jacquard machine structured to increase the probability of proper operation of the lifting wires with the associated structure, thereby avoiding, or at least minimizing, expensive downtime of the loom and costly repairs.

Now in order to implement these and still further objects of the invention, which will become more readily apparent as the description proceeds, the Jacquard machine of the present invention is manifested by the features that there is provided at least one stationary guide edge at the region of the stationary arresting blade fixing the lower shed position, this guide edge cooperating with a projection located at the neighboring lifting wire moving into the lower shed position, so that the lifting wire is deflected and when assuming the lower shed position is coupled with the associated stationary arresting blade.

With the inventive Jacquard machine or loom there can be obtained an extremely positive coupling or engagement between the lifting blades and the lifting wires such that the lifting wire-entrainment hooks positively remain at the region of the lifting blade-entrainment hooks, so that possible errors which may arise with respect to the coupling operation at the lifting wire-entrainment hooks and the lifting blade-entrainment hooks or during the so-called shifting or depressing operation of the shifting or depressing needles is immediately itself compensated. Even if, for instance, a lifting wire-entrainment hook nests with its tip upon the tip of an associated lifting blade-entrainment hook, as shown for instance in FIG. 4, and should jump out of this unstable position, nonetheless the lifting wire only can drop to such an extent, as shown for instance in FIG. 2, that it is coupled with its arresting hook in the arresting blade hooks provided for the lower shed. Further dropping of the lifting wire is impossible.

The lifting wire can be again guided upwardly at any time, out of the lower shed position, by an upwardly moved lifting blade, so that the operation can proceed immediately automatically. The mode of operation of the Jacquard machine therefore becomes particularly free of disturbances and loom downtime.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figures 1, 2, 3, 4, 5:
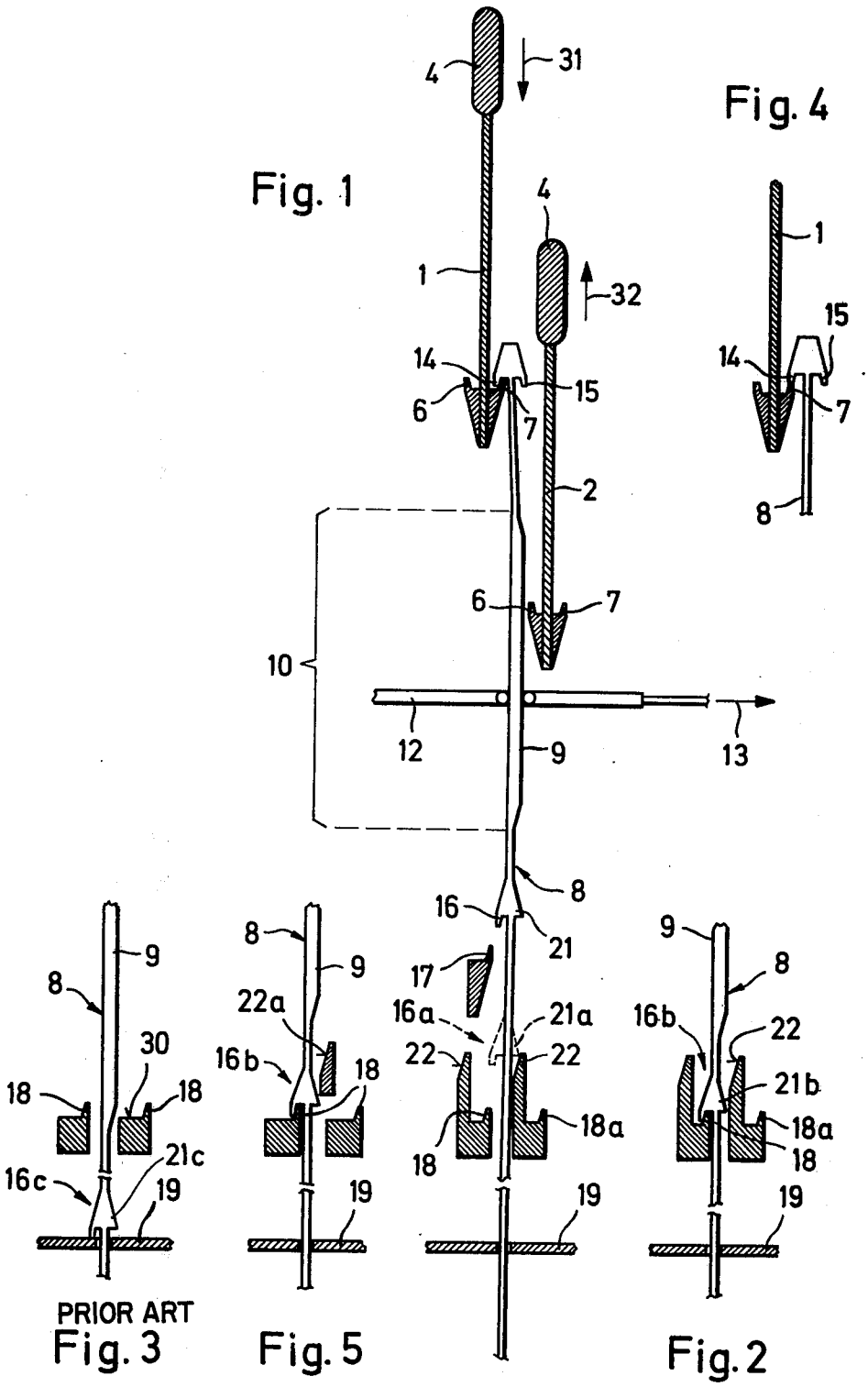
Fig. 4 PRIOR ART
FIG. 1 illustrates a first position of lifting wire arrangement of a Jacquard machine constructed according to the present invention.
FIG. 2 illustrates the lifting wire arrangement of FIG. 1, in fragmentary view, in a different position.
FIG. 3 illustrates, for comparative purposes, a position assumed with a lifting wire arrangement not constructed according to the present invention.
FIG. 4 illustrates a further position of the lifting wire arrangement of the invention.
FIG. 5 shows a modified construction of the invention.

Describing now the drawings, it is to be understood that only enough of the structure of the Jacquard machine or loom has been shown to enable those skilled in the art to readily understand the underlying concepts and principles of the present invention. Both of the lifting blades 1 and 2 will be seen to each have an upper beam 4, by means of which they can be driven and placed into a reciprocal up and down movement. At its lower end each such lifting blade 1 and 2 is provided with the entrainment hooks 6, 7 coacting with the hooks 14, 15 of the lifting wires 8, of which only one has been specifically shown to preserve clarity in illustration. These lifting wires or hooks 8 can be shifted or pushed in the direction of the arrow 13 of FIG. 1, in other words towards the right, by means of the so-called shifting or depressing needles 12, also known in the art as Jacquard needles. FIG. 1 illustrates the so-called shifted or depressed position for the therein illustrated lifting wire 8.

Below the shifting or depressing needles 12 there are stationarily arranged the arresting blades 17 fixing the upper shed position of the lifting wires 8 and furthermore the likewise stationary arresting blades 18 fixing the lower shed position. To provide the necessary coaction between the lifting wires 8 and the arresting blades 17, 18 these lifting wires 8 are provided with the arresting hooks or tongues 16 or equivalent structure. Considerably below the arresting blade 18 there is located a lifting wire board or floor 19.

The mode of operation of the above-discussed Jacquard machine is as follows:

Initially there is assumed a starting position where the lifting blade 1 is in its lower reversing position, the lifting blade 2 is in its upper reversing position and the lifting wire 8 with its arresting hook 16 is suspended in the stationary arresting blade 17 (upper shed position of the lifting wire). The shifting or depressing needle 12 is located in its left, ineffectual position, where the lifting wire 8 is not depressed or shifted towards the right.

Now the lifting blade 1 is moved upwards and at the same time the lifting blade 2 downwards. The hook 7 engages in the hook 14 and entrainably shifts the lifting wire 8 upwards. Thereafter, the shifting or depressing needle 12 is moved towards the right, as indicated by the arrow 13, so that the lifting wire 8 is primarily shifted or depressed at its intermediate shifting region 10 reinforced by a widened or enlarged portion 9. As soon as the arresting hook 16 is sufficiently elevated it is uncoupled from the upper arresting blade 17 and snaps towards the right. The components then reach the illustrated position (upper reversing position of the lifting blade 1 and at the same time the lower reversing position of the lifting blade 2).

Then, the lifting blade 1, as indicated by the arrow 31, is moved downwards and the lifting blade 2, as indicated by the arrow 32, is moved upwards. The lifting wire 8, under the action of a not particularly illustrated but conventional spring, together with the lifting blade 1 moves downwards and remains depressed, so that the hook 16 can move past and to the right of the arresting blade 17.

Finally, the hook 16 arrives at the position, indicated by the hook **16*a* shown in phantom lines in FIG. 1, where a rearward projection 21 assumes the position shown by phantom lines 21*a* in FIG. 1, where it impacts against an inclined guide edge 22 of the lower arresting blade 18*a*. Due to the resulting guiding action, and during further downward movement of the components 1 and 8, the hook 16 finally is shifted into the position, shown by the hook 16*b* illustrated in phantom lines in FIG. 2, where it is coupled with the lower arresting blade 18**.

As a general rule the shifting or depressing needle 12 is again guided towards the left out of the illustrated shifted or depressed position, shortly prior to the coupling of the hooks 16, 18, so that also the arresting hook 16 and the projection 21 can snap or otherwise return towards the left. Even if these operations for some reason or other are not carried out exactly as explained, nonetheless there is ensured that in any event the hook 16 will be suspended in the hook 18 and specifically due to the guide edge 22. The lifting wire 8 cannot drop, for instance, into such a low position that the hook 16 can assume the position indicated by the hook **16*c* shown in phantom lines in FIG. 3 for comparative purposes which relates to a construction of Jacquard machine which is not equipped with the guide edge 22, and where, as it will be noted, such lifting wire can seat upon the lifting wire board 19 arranged a considerable distance beneath the hook 18 and further where the hooks 14, 15 no longer can be coupled with the hooks 7, 6**.

During the upward movement of the lifting blade 1 it can happen at times that the hooks 7, 14 seat or nest upon one another, as shown in FIG. 4, as opposed to fixedly engaging or interlocking with one another. Out of this unstable position it is possible for the hook 14 to easily snap towards the right of FIG. 4, so that also in such case, during lowering of the lifting wire 8, the hooks 16, 18 will come into engagement with one another.

Also, it is not possible for there to arise the situation where the lifting wire 8 can seat by means of its rearward projection 21 for instance at the surface 30 (FIG. 3) of the known constructions of hooks 18, and thus again there would be present an unstable position of the components which could endanger further proper operation of the loom.

Finally, a modified construction of the invention, shown in FIG. 5, contemplates that the guide edges **22*a* are separate components in relation to the lower, stationary arresting blades 18. For instance, all of the guide edges 22*a*** could collectively form a special grid.

While there are shown and described present preferred embodiments of the invention, it is to be distinctly understood that the invention is not limited thereto, but may be otherwise variously embodied and practiced within the scope of the following claims.

Accordingly, what is claimed is:

1. In a Jacquard machine having to-and-fro moving lifting wires provided with arresting hooks for coupling the lifting wires with stationary arresting blades, the improvement of a stationary arresting blade for fixing a lower shed position, at least one stationary guide edge provided at the region of said stationary arresting blade, a lifting wire neighboring said stationary arresting blade and movable into the lower shed position, a projection provided at said neighboring lifting wire, said guide edge cooperating with said projection when the lifting wire travels into the lower shed position, in order to deflect said lifting wire, and when the lifting wire assumes the lower shed position the lifting wire is coupled by means of its arresting hook with the stationary arresting blade.

2. The improvement as defined in claim 1, wherein the stationary guide edge is located at the stationary arresting blade which fixes the lower shed position and enables the lifting wire to be guided.

3. The improvement as defined in claim 1, wherein said projection of said lifting wire is arranged at the region of said arresting hook of said lifting wire.

* * * * *